US005118145A

United States Patent [19]

Tucker

[11] Patent Number: 5,118,145

[45] Date of Patent: Jun. 2, 1992

[54] UNIVERSAL WINDOW SASH LOCK FOR A VARIETY OF WINDOWS

[75] Inventor: Daniel G. Tucker, Waseca, Minn.

[73] Assignee: Truth Division of SPX Corporation, Owatonna, Minn.

[21] Appl. No.: 700,491

[22] Filed: May 15, 1991

[51] Int. Cl.[5] ..... E05C 1/06

[52] U.S. Cl. ..... 292/158; 292/23; 292/DIG. 64; 403/348; 403/353

[58] Field of Search ..... 292/DIG. 64, 23, 139, 292/158, 167, 263, DIG. 43, DIG. 29; 403/348, 353

[56] References Cited

U.S. PATENT DOCUMENTS

| | | | |
|---|---|---|---|
| 1,116,617 | 11/1914 | Page | 292/139 |
| 1,808,458 | 6/1931 | Flynn | 292/167 |
| 2,348,654 | 5/1944 | Schmitt | 292/263 |
| 2,721,750 | 10/1955 | Rudis et al. | 292/139 |
| 3,485,112 | 12/1969 | Goosmann | 403/353 X |
| 4,025,096 | 5/1977 | Geer | 292/139 X |
| 4,182,144 | 1/1980 | Leivenzon et al. | 292/139 X |
| 4,627,304 | 12/1986 | Dougherty et al. | 403/348 X |
| 4,991,886 | 2/1991 | Nolte et al. | 403/353 X |

*Primary Examiner*—Richard E. Moore

*Attorney, Agent, or Firm*—Wood, Phillips, Van Santen, Hoffman & Ertel

[57] ABSTRACT

A universal lock for securing any of a variety of different design window sashes closed against any of a variety of different design window frames. The lock includes a pair of spaced keepers on the window sash, and a tie bar mounted to the window frame and having a pair of rollers thereon. The tie bar is reciprocable along its axis to selectively move the rollers into or out of engagement with the keepers of the closed window sash to selectively lock or release the sash from the frame. A base pivotally mounts a handle member to the window frame. A coupler link is pivotally secured at one end to the handle member and has a flange at the other end pivotally secured to the tie bar. The flange has a narrow portion with a first width adjacent the coupler link and a wide portion with a second width spaced from the coupler link. The tie bar includes an opening with a substantially circular portion having a diameter greater than the first width and less than the second width, and a slot portion wider than the second width. The coupler link is positioned at a non-operational angle relative to the tie bar during assembly to allow passage of the flange wide portion through the tie bar opening slot portion. The flange wide portion thereafter holds the coupler link to the tie bar with the flange narrow portion pivotable within the tie bar opening circular portion during operation (i.e., locking and releasing) pivoting.

6 Claims, 2 Drawing Sheets

Fig. 1
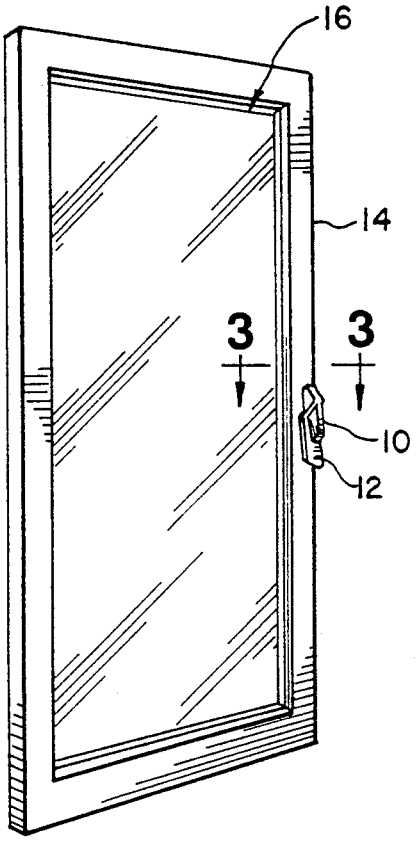
Fig. 2
PRIOR ART
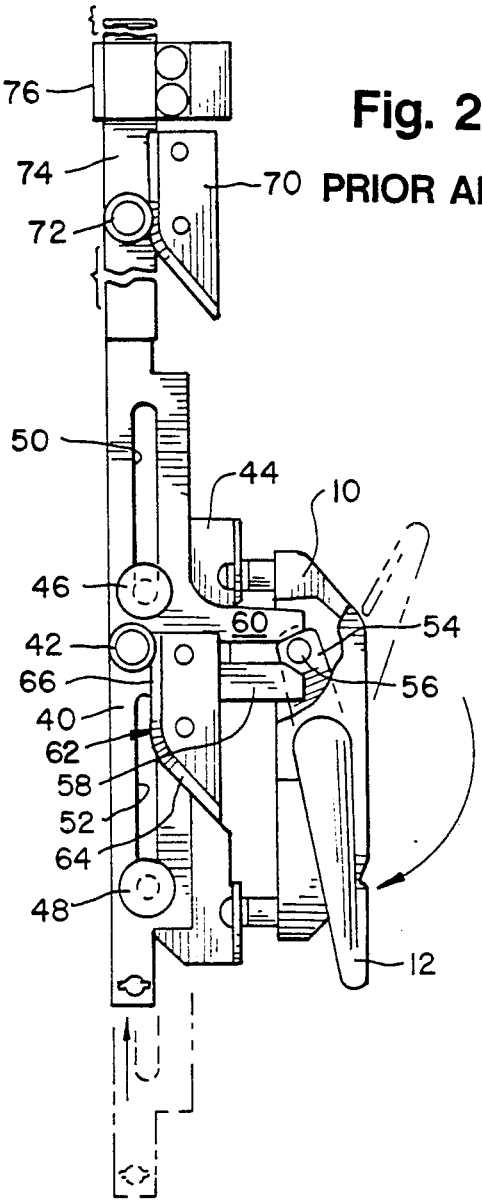
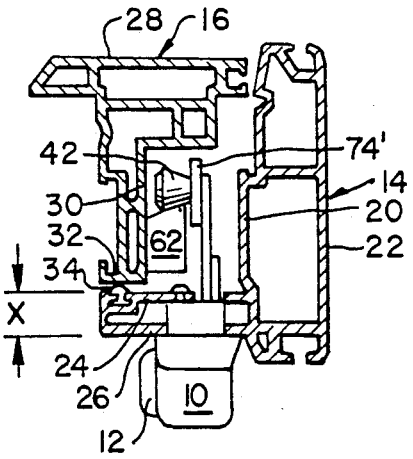
Fig. 3
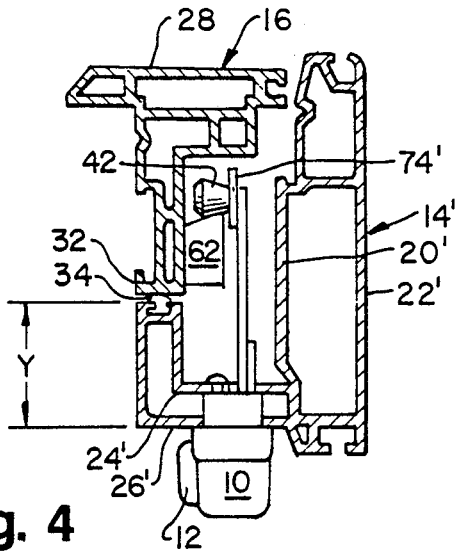
Fig. 4

UNIVERSAL WINDOW SASH LOCK FOR A VARIETY OF WINDOWS

BACKGROUND OF THE INVENTION

1. Technical Field

The present invention is directed toward a window lock, and more particularly toward a window lock which is adaptable for use with different windows having different window sash and frame configurations.

2. Background Art

Window locks are known in the art that generally involve having a catch with a handle operator affixed to a window frame which interacts with a keeper on a corresponding section of a movable window sash to securely hold the sash tightly against the frame. Also known in the art are devices for sequential multi-point lock-up of the movable window sash with the window frame. These latter devices are locks which have a handle actuator interacting with a keeper at one point on a window frame and sash respectively which causes a second lock to engage a keeper at a distant location.

Commonly owned Nolte et al. U.S. Pat. No. 4,991,886, hereby incorporated by reference, discloses such a multi-point lock for a window sash. This device uses a tie bar connecting two spaced apart cam members or rollers which can interact with keepers affixed to a window sash to establish a locked condition of the window. The movement of a handle actuator from its unlocked position causes the adjacent roller on the tie bar to connect with a planar portion of an associated ramped keeper. Continued movement of the handle actuator causes the tie bar to also move the second roller onto the planar section of the second associated ramped keeper.

Unfortunately, because locks such as the above are used in many different windows having window frames and window sashes with a variety of dimensions and configurations, the spacing of the handle actuator from the tie bar axis can vary between installations. This can result in such locks either being usable with only one style window, or alternatively can undesirably require that different locks be manufactured for each different possible window. The later alternative not only significantly increased manufacturing costs, but it also requires builders to maintain undesirably large inventories of such locks. Further, such large inventories of different locks can result in serious and costly construction delays if the wrong locks are delivered to a particular installation.

Of course, the above concerns would be ideally met by a universal lock which not only is usable in a variety of installations but which also provides smooth, reliable, and secure operation.

The present invention is directed toward overcoming one or more of the problems set forth above.

SUMMARY OF THE INVENTION

In one aspect of the present invention, to provide a universal lock for securing any of a variety of different design window sashes closed against any of a variety of different design window frames. The lock includes a pair of spaced keepers on the window sash, and a tie bar mounted to the window frame and having a pair of rollers thereon. The tie bar is reciprocable along its axis to selectively move the rollers into or out of engagement with the keepers of the closed window sash to selectively lock or release the sash from the frame. A base pivotally mounts a handle member to the window frame. A coupler link is pivotally secured at one end to the tie bar and at the other end to the handle member, whereby pivoting of the handle member moves the coupler link through an arc at the other end and along the axis at the one end.

In another aspect of the present invention, the coupler link includes a flange on its one end, said flange having a narrow portion with a first width adjacent the coupler link and a wide portion with a second width spaced from the coupler link. The tie bar includes an opening with a substantially circular portion having a diameter greater than the first width and less than the second width, and a slot portion wider than the second width. This coupler link may be positioned at a non-operational angle relative to the tie bar during assembly to allow passage of the flange wide portion through the tie bar opening slot portion, the wide portion thereafter holding the coupler link to the tie bar with the flange narrow portion pivotable within the tie bar opening circular portion during operational (i.e., locking and releasing) pivoting.

It is an object of the invention to provide a multi-point locking structure which provides secure and reliable operation without binding.

It is a further object of the invention to provide a locking structure which may be used in many different windows having window frames and window sashes with a variety of dimensions and configurations without requiring that different parts be manufactured, inventoried, and delivered to such different window designs. Related objects of the present invention are, therefore, to provide a multi-point locking structure which can be inexpensively manufactured, and which can be easily and inexpensively inventoried and handled by the lock installers.

BRIEF DESCRIPTION OF THE DRAWINGS

FIG. 1 is perspective view of a closed window embodying the window lock of the present invention;

FIG. 2 is a side, partial view of the operational components of a prior art multi-point window lock;

FIG. 3 is a cross sectional view taken along line 3—3 of FIG. 1;

FIG. 4 is a cross sectional view similar to FIG. 3 but showing the invention as used with a different window frame design;

DESCRIPTION OF THE PREFERRED EMBODIMENT

Figure 5:
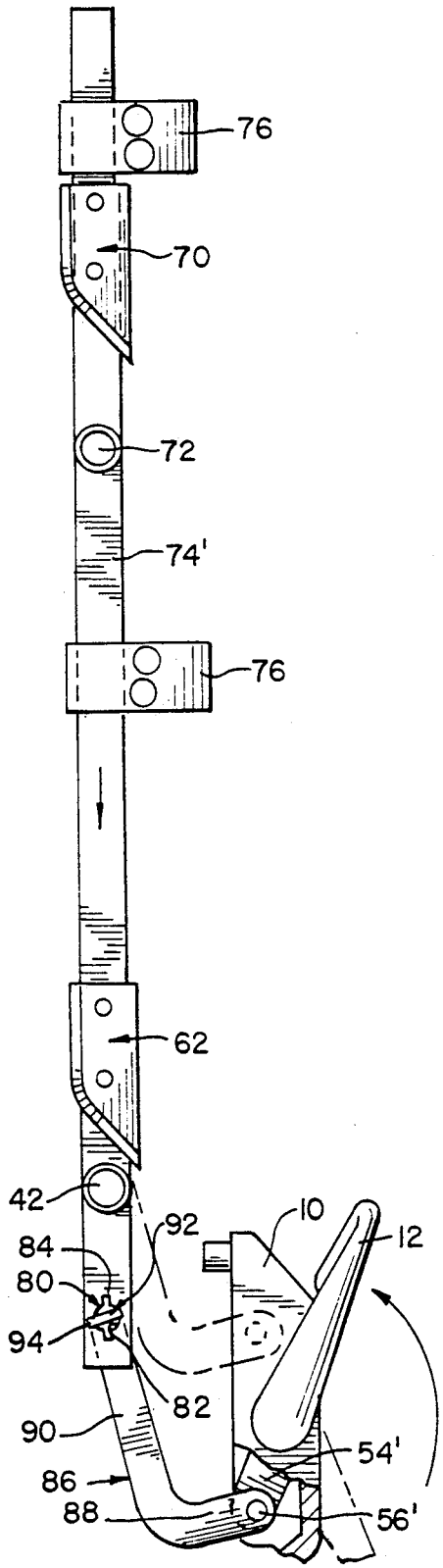
FIG. 5 is a side, partial view of the operational components of a multi-point window lock embodying the present invention as used with a window frame design such as shown in FIG. 3, said lock being shown in the released, unlocked position.

The window lock is shown in association with a window in FIG. 1 and with the only room-visible part thereof being a housing 10 and a handle 12.

The window has a window frame, indicated generally at 14, in which the window sash, generally indicated at 16, of a casement window is pivotally mounted. The mounting of such a window by hinges is well known in the art. As is also well known, a window operator (not shown) may be used with such windows for moving the window sash between closed and fully open positions or any desired position therebetween.

As will be readily recognized, the window lock can also be used for an awning-type window wherein the pivotal movement of the window sash would be generally about a horizontal axis, rather than the vertical axis of the casement window. The concepts embodied in the window lock could be utilized with other types of movable windows, such as a double hung window.

The window lock has particular utility with a vinyl window and an embodiment of a vinyl window is shown fragmentarily in FIG. 3. The window frame 14 has vertical wall sections 20, 22 suitably integrally interconnected by interconnecting walls and with a pair of interconnected vertical walls 24, 26 extending at right angles thereto and with the wall 26 defining a room-facing surface of the window frame.

The window sash 16 has a vertical exterior wall 28 with integrally associated walls including a wall 30 extending normal thereto which defines one of the walls mounting a vertical face panel 32 which can be brought closely adjacent to the vertical frame wall 24 when the window is closed and with a suitable weather strip 34 assuring a tight seal.

In the prior art structure shown in FIG. 2 and in commonly owned Nolte et al. U.S. Pat. No. 4,991,886, the lock has a slider 40 movable in a path extending lengthwise thereof and which mounts a cam member, in the form of a roller 42. The slider 40 is movable in said path by its mounting on a bracket 44 which mounts a pair of shoulder guide rivets 46, 48 which extend through the respective slider slots 50, 52, respectively, and which enable movement of the slider 40 from the window unlocked position (shown partially in phantom in FIG. 2) to the window locked position (as illustrated in FIG. 2).

The housing 10 rotatably mounts the handle 12 for movement between two limit positions. One of these limit positions is the window locked position, as shown in FIG. 3, wherein the handle 12 extends downwardly and generally parallel to the frame wall 26. Counterclockwise pivoting (from the FIG. 2 perspective) of the handle 12 moves the locking structure to its other limit position, which is the window unlocked (or released) position.

The slider 40 and handle 12 have coacting means whereby rotation of the handle results in linear movement of the slider 40 along the path lengthwise of the slider 40. This coacting means comprises a drive link or handle link 54 splined to the handle at its rotation axis and which has a pin 56 which coacts with a forked section of the slider 40. The forked section has a pair of tines 58, 60 with an open-ended slot therebetween. With the window lock in locked condition and with the handle 12 in the locked position and with the handle 12 in the position shown in FIG. 2, the handle 12 can be rotated in a counterclockwise direction and, during this rotation, the pin 56 will move sequentially inwardly and outwardly of the slot and in engagement with the tine 58 to lower the slider 40. Conversely, with the window lock in unlocked condition, the handle 12 can be rotated in a clockwise direction and, during this rotation, the pin 56 will move sequentially inwardly and outwardly of the slot and in engagement of the tine 60 to raise the slider 40.

The previously mentioned slider roller 42 coacts with a ramped keeper 62 which is mounted by suitable means on the vertical wall 30 of the window sash. The ramped keeper 62 has an inclined ramp section 64 and a generally planar section 66. The ramped keeper 62 is shown in FIG. 2 in relation to the roller 42 when the window sash is fully closed. With counterclockwise rotation of the handle 12, the slider 40 moves downwardly and the roller 42 engages the inclined ramp section 64 and then clears the keeper 62 completely to unlock the window. Conversely, clockwise rotation of the handle 12 from the unlocked condition moves the slider 40 upwardly so that the roller 42 first re-engages the inclined ramp section 64 and then rolls therealong to draw and maintain the window sash 16 fully closed when the roller 42 moves onto the generally planar section 66 of the ramped keeper 62.

In order to achieve multi-point locking, the window sash 16 mounts a second ramped keeper 70 having the same construction as the ramped keeper 62 and at a distance therefrom. A second cam member or roller 72 coacts with the ramped keeper 70. This roller 72 is rotatably-mounted on a tie bar 74 which is connected to an end of the slider 40 for lengthwise movement therewith. A tie bar guide 76 is suitably fastened to the frame 14 (such as to frame wall 20) to guide the tie bar 74 to ensure proper lengthwise movement of the tie bar 74 along its axis.

The multi-point locking is achieved with delayed lock-up of the roller 72 and ramped keeper 70 relative to the roller 42 and ramped keeper 62 by the slider 40 having a length of movement along its path greater than that required to move a roller along the inclined ramp section 64 and onto a generally planar section 66 of a ramped keeper and having the ramped keepers at a distance apart greater than the distance between the rollers. A generally planar section of a ramped keeper has a length greater than the differences in the distances to provide a dwell for one roller while the other roller is on an inclined ramp section.

Figure 6:
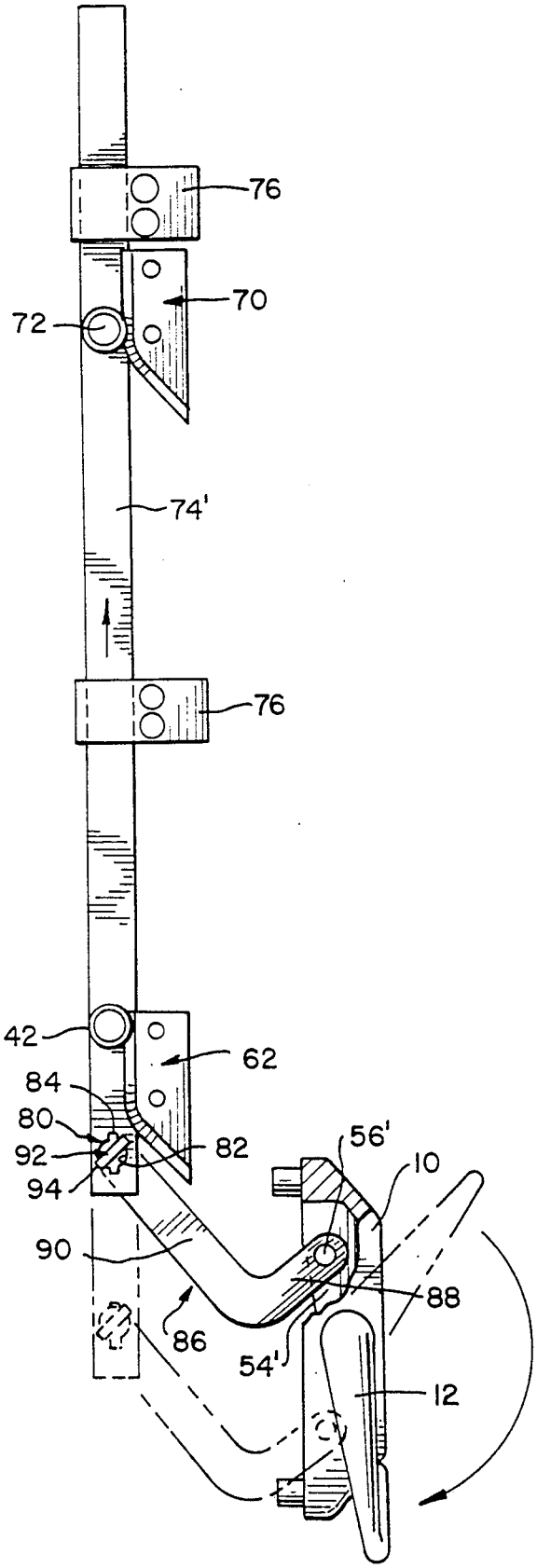
FIG. 6 is view similar to FIG. 5, but is exaggerated to show the lock as used with a different window frame (such as shown in FIG. 4) and in the locked position.

The present invention allows a single design of the above locking concept to be used with the many different window configurations which are now, and may hereafter be, in use. Specifically, whereas the FIG. 3 frame has a spacing "X" between the sash face panel 32 and the frame room facing wall 26, a different frame 14' such as shown in FIG. 4 can result in a significantly different spacing "Y" between the sash face panel 32 and the frame room-facing wall 26' (note that reference numerals in FIGS. 4–6 are identical to those in FIGS. 1–3 for identical components, and are the same primed [e.g., "14'"] for similar but non-identical components). Such different spacings result in different offsets from the axis of the tie bar to the pivot axis of the handle.

Such different spacings can be accomplished by use of the present invention disclosed in FIGS. 5 and 6.

Specifically, a tie bar 74' is secured to the window frame (not shown in FIGS. 5 and 6 to avoid clutter in the drawings) by suitable tie bar guides 76 for linear reciprocation along the tie bar axis. Similarly, the ramped keepers 62, 70 are secured to the sash (also not shown in FIGS. 5 and 6). Rollers 42, 72 are fixed to the tie bar 74'. Spacing of the rollers 42, 72 and the keepers 62, 70 from one another is selected to provide the desired sequence of locking. For example, FIGS. 5 and 6 illustrate the rollers 42, 72 and keepers 62, 70 with spacing to provide the above described delayed lock-up.

The lower end of the tie bar 74' includes an opening 80 with a substantially circular portion 82 and a slot portion 84.

An L-shaped coupler link 86 has a short leg 88 and a long leg 90. The link short leg 88 is pivotally secured at an end to the drive link 54' by suitable means such as a pin 56'.

The link long leg 90 is pivotally secured at an end to the tie bar 74'. Specifically, the coupler link 86 includes a flange 92 on the long leg end substantially perpendicular to the long leg 90. The flange 92 includes a narrow portion with a first width adjacent the long leg 90 and pivotable within the opening circular portion 82. The flange 82 also includes a wide portion 84 with a second width spaced from the long leg 90.

This connection of the link 86 to the tie bar 74' allows for easy assembly and installation of the lock. Specifically, during assembly, the link long leg 90 may be positioned substantially perpendicular to the tie bar 74' so that the flange wide portion 94 is aligned with the opening slot portion 84. Once the flange wide portion 94 is then passed through the tie bar opening 80, the link 86 may be pivoted down, with the flange narrow portion being guided within the opening circular portion 82 for pivotal motion of the link 86 relative to the tie bar 74'. The flange wide portion 94, being wider than the opening circular portion 82, holds the link 86 to the tie bar 74' during such operational positions of the link 86.

In a preferred embodiment of the present invention, the coupler link 86 includes a short leg 88 which is approximately ¾ of an inch long and a long leg which is approximately 3 inches long. It has been found that in virtually all window designs, a coupler link 86 having these dimensions will provide the necessary range of operational motion without the link long leg 90 being pivoted more than about 15° from the tie bar axis.

With this structure, as shown in FIG. 5, counterclockwise pivoting of the handle 12 (from the position shown in phantom) causes the drive link 54' to pivot the pin 56' through an arc, carrying the coupler link short leg 88 down with it. The coupler link long leg 90 simultaneously pulls down on, and pivots relative to, the tie bar 74' (which is constrained for only axial movement by the tie bar guides 76). Such motion thus pulls the rollers 42, 72 off the keepers 62, 70 to unlock the window.

Conversely, clockwise rotation of the handle 12 (from the position shown in phantom in FIG. 6) causes the drive link 54' and coupler link 86 to push the tie bar 74' up so that the rollers 42, 72 engage the keepers 62, 70, locking the window sash 16 to the window frame.

Further, as can clearly be seen from a comparison of FIGS. 5 and 6, this identical structure (with completely identical components) can be used with different window designs where the spacing from the tie bar 74' to the room facing frame surface (similar to X and Y n FIGS. 3 and 4) differs significantly.

Still further, it will be understood from the above disclosure that the L-shape of the coupler link 86 allows a minimum size handle housing 10 to be utilized since the coupler link short leg 88 is oriented to project substantially directly toward (and into) the housing 10. That is, the housing 10 need not be angled or enlarged to accommodate a link which, depending on the window design, could interfere with the upper or lower end of the housing in its range of motion during changing between locking and releasing positions.

As a result of using this significantly improved structure, the previously known multi-point locking structure providing secure and reliable operation can be utilized in many different windows having window frames and window sashes with a variety of dimensions and configurations. Further, since different parts are not required for different window designs, widespread use of these locks may be accomplished with minimum expense and problems. Specifically, the costs and problems which can arise are minimized during (1) manufacture (mass production of a single set of components is possible), (2) inventorying (many different components usable with every possible window design need not be separately inventoried by suppliers), (3) delivery (there is no risk of delay as the result of delivering a lock which is not usable with the particular window design), and (4) installation ( the installer need not worry about different components and/or different installation techniques being required for different windows).

Still other aspects, objects, and advantages of the present invention can be obtained from a study of the specification, the drawings, and the appended claims.

I claim:

1. A universal lock for securing any of a variety of different design window sashes closed against any of a variety of different design window frames, comprising:

a pair of spaced keepers on said window sash;

a tie bar mounted to the window frame, said tie bar having a pair of rollers thereon and being reciprocable along its axis to selectively move said rollers into or out of engagement with the keepers of the closed window sash to selectively lock or release the sash from the frame;

a base mounted pivotally securing a handle member thereto, said base being mounted directly to the window frame independently of said tie bar; and a coupler link pivotally secured at one end to the tie bar and pivotally secured at the other end to the handle member, whereby pivoting of said handle member moves said coupler link through an arc at said other end and along said axis at the one end.

2. The universal lock of claim 1, wherein said coupler link is L-shaped with a short leg and a long leg, with said link one end on the long leg and the link other end on short leg.

3. The universal lock of claim 2, wherein the long leg is at lest two times as long as the short leg.

4. In a multi-point window lock having two keepers securable to a window sash, two rollers secured to a tie bar which is mountable to a window frame for axial reciprocation to selectively move the rollers into or out of engagement with the keepers to selectively lock or release the sash from the frame, the improvement comprising:

a base mounting a handle and handle link for unitary pivotal movement relative to the frame, said base being mounted directly to the window frame independently of said tie bar; and an L-shaped coupler link having a short leg and a long leg, said link short leg being pivotally secured at an end to the handle link and said link long leg being pivotally secured at an end to the tie bar, whereby pivoting of said handle pivots said handle link to move said coupler link short leg end through an arc and move said coupler link long leg end along said axis, and said coupler link long leg pivots no more than 20° from the axis.

5. The improved connecting means of claim 4, wherein the long leg is at least three times as long as the short leg.

6. The improved connecting means of claim 4, wherein said base comprises a housing with a side open toward the window frame, and said handle link pivots within the said open housing side with the coupler link short leg extending into the open housing side.

* * * * *